US006751877B2

(12) United States Patent
Grove

(10) Patent No.: US 6,751,877 B2
(45) Date of Patent: Jun. 22, 2004

(54) WEARABLE ADJUSTABLE GARMENT PATTERN TEMPLATE

(76) Inventor: Carol S. Grove, 12 Butler St., Brooklyn, NY (US) 11231

( * ) Notice: Subject to any disclaimer, the term of this patent is extended or adjusted under 35 U.S.C. 154(b) by 0 days.

(21) Appl. No.: 10/195,593

(22) Filed: Jul. 15, 2002

(65) Prior Publication Data

US 2004/0006878 A1 Jan. 15, 2004

(51) Int. Cl.[7] ..... A41H 3/00

(52) U.S. Cl. ..... 33/17 R; 33/2 R; 33/11; 33/512; 33/562

(58) Field of Search ..... 33/562, 494, 2 R, 33/11, 17 R, 464, 809, 679.1, 512

(56) References Cited

U.S. PATENT DOCUMENTS

| | | | | | |
|---|---|---|---|---|---|
| 18,958 | A | | 12/1857 | Corley | |
| 52,950 | A | | 3/1866 | Beard | |
| 174,443 | A | | 3/1876 | Roudel | |
| 213,436 | A | | 3/1879 | McDowell | |
| 310,297 | A | | 1/1885 | McDowell | |
| 342,216 | A | | 5/1886 | McDowell | |
| 456,184 | A | * | 7/1891 | Wolff | 33/2 R |
| 457,124 | A | | 8/1891 | Liebl | |
| 545,139 | A | * | 8/1895 | Start, Jr. et al. | 33/2 R |
| 633,654 | A | * | 9/1899 | Melick | 33/2 R |
| 655,960 | A | * | 8/1900 | Cunningham | 33/2 R |
| 750,975 | A | | 2/1904 | Horne | |
| 855,272 | A | | 5/1907 | Barnett | |
| 899,802 | A | * | 9/1908 | Pohle | 33/2 R |
| 902,704 | A | | 11/1908 | Anderson | |
| 979,866 | A | | 12/1910 | Little | |
| 1,042,063 | A | | 10/1912 | Wendorf | |
| 1,101,140 | A | | 6/1914 | Morrison | |
| 1,201,217 | A | | 10/1916 | Miyamoto | |
| 1,278,107 | A | * | 9/1918 | Cherrie et al. | 33/2 R |
| 1,612,385 | A | | 12/1926 | Lopez | |
| 1,784,888 | A | * | 12/1930 | Couture | 33/2 R |
| 1,935,998 | A | | 11/1933 | Stradling | |
| 2,109,823 | A | | 3/1938 | Guillot | |
| 2,150,305 | A | | 3/1939 | Welsh | |
| 2,231,437 | A | | 2/1941 | Cieri | |
| 2,716,817 | A | | 9/1955 | Franklin | |
| 2,814,878 | A | | 12/1957 | Kolthoff et al. | |
| 2,869,236 | A | | 1/1959 | Franklin | |
| 3,085,340 | A | | 4/1963 | Rashbaum | |
| 3,683,504 | A | | 8/1972 | Roth | |
| 3,964,169 | A | | 6/1976 | Bush | |
| 4,104,800 | A | | 8/1978 | Dyal | |
| 4,184,260 | A | | 1/1980 | Brockman | |
| 4,205,446 | A | | 6/1980 | Gibson | |
| 4,307,516 | A | | 12/1981 | Walker | |
| 6,233,839 | B1 | * | 5/2001 | Ford | 33/562 |
| 6,266,889 | B1 | * | 7/2001 | Boyce | 33/494 |

* cited by examiner

*Primary Examiner*—Diego Gutierrez
*Assistant Examiner*—Madeline Gonzalez
(74) *Attorney, Agent, or Firm*—Gordon & Jacobson, P.C.

(57) ABSTRACT

A wearable garment pattern template configured to be worn by a person includes a plurality of detachably coupled sections each having a plurality of flexible segments which are coupled at pivot points. The adjustable segments include at least two strips which are longitudinally slidable relative to each other such that the segments are adjustable in length and can also be fixed in length. The segments define a framework of either triangles with sides of a particular length (as adjusted on the wearer), or quadrilaterals having sides of a set length (as adjusted on the wearer) and at least one fixed angle between two of the sides. In either instance, after adjustment, each triangle or quadrilateral can be only in one configuration, and is not subject to distortion due to rotation about pivot points. The garment pattern template can be used as a template to cut fabric for a garment.

19 Claims, 12 Drawing Sheets

WEARABLE ADJUSTABLE GARMENT PATTERN TEMPLATE

BACKGROUND OF THE INVENTION

1. Field of the Invention

This invention relates broadly to geometrical instruments used in the manufacture of apparel. More particularly, this invention relates to a wearable adjustable garment pattern template.

2. State of the Art

A pattern piece used for making garments is a template, and is used to cut fabric into a particular shape. A template's shape and ability to permit recordation of measurements (e.g., side lengths, areas defined by particular portions, and dart lengths and angles) are its most important qualities. If a template cannot maintain its shape, it is useless.

Referring to prior art FIG. 1, U.S. Pat. No. 2,869,236 to Franklin (hereinafter 'the Franklin patent') discloses a wearable template 10 comprising a plurality of strips 12, 14, 16, 18, 20, 22, 24, 26 and 28 arranged in a grid-like manner with pivots 30 at intersections of the strips. The pivots 30 can be adjustably located along the length of the strips to effectively adjust the lengths of the strips to fit the template to a wearer of the template. However, the template 10 is not adapted to maintain its shape after it is removed from the wearer. This is because the strips of the template form a plurality of freely pivoting parallelograms that can easily pivot out of shape, as shown in prior art FIGS. 2 and 3.

Franklin partially addresses the out-of-shape pivoting of the template, and teaches that a separate garment pattern positioner device, as described in U.S. Pat. No. 2,716,817 also to Franklin, be used to hold a front 'neck' strip 16 and 'center' strip 18 in angular relation during adjustment of the template relative to a pattern sheet. However, there is no teaching or suggestion to use such a pattern positioner to hold the 'bust line' strip 24 perpendicular to the front 'center' strip 18. Moreover, even if such a pattern positioner where used in this manner, distortion in the pattern will nevertheless occur at the dart strips 32 (FIGS. 4 and 5).

Darts are basically stitched tapering folds in fabric required to make two dimensional fabric fit over a three dimensional form, such as a human body. The Franklin patent asserts that the template described therein provides dart measurements. However, the only dart measurement provided by the Franklin template is length; there is no manner of providing the important intake measurements for the darts. In fact, referring to prior art FIGS. 4 and 5, experimentation on a mock-up of a right front bodice template manufactured according to the Franklin reference shows that the bust dart 32 on this template can be moved from 12° (FIG. 4) to 58° (FIG. 5), all at the same dart length. There is only a 10° difference between cup sizes in a female bodice garment. As such, failure to properly account for the dart intake can introduce a large amount of distortion in a template. Moreover, this distortion can happen even if the front neck strip 16, center strip 18, across chest strip 22 and bust line strip 24 are all held rigidly in position. Another problem with respect to dart measurements provided by the template of the Franklin patent is that particular strips, without being split, cut through the space of the darts and prevent proper measurement of the dart intake as well as the line crossing the dart and/or transfer of the recorded measurement to fabric or paper.

The Franklin template has several others problems as well. For example, particular strips of the Franklin template are too long, and must curve along shaped areas of the body such as the high hip. This introduces additional distortion in the recorded measurements of those strips. In addition, the apex of particular darts (mainly on the skirt) are free to pivot a full 180° and sufficiently distort to become indistinguishable from the waist strips. Furthermore, the pattern template is being built one strip at a time on a person. It would be faster to take all the measurements using a tape measure. Moreover, it is taught to connect the strips with paper fasteners extending through holes in the strips. Not only would it be awkward to use paper fasteners to adjust strips while a person is wearing them, it would also be very time consuming. For example, if one is fitting a bodice and skirt template on a person, there would be as many as six holes to line up and couple with paper fasteners therethrough while the person is wearing the pattern template. In addition, the strips extend past the perimeter of the piece. These extensions interfere with fitting other template sections (e.g., sleeves to bodice, bodice to skirt, etc.) together. Also, the extensions must be very long and unwieldy in order to accommodate people of various sizes. As a result of several of the above reasons, it would not be possible to fit the Franklin template to one's self, which may be desirable.

SUMMARY OF THE INVENTION

It is therefore an object of the invention to provide a wearable garment pattern template.

It is another object of the invention to provide a wearable garment pattern template which maintains its shape.

It is a further object of the invention to provide a wearable garment pattern template that provides proper dart intake and length measurements.

It is also an object of the invention to provide a wearable garment pattern template that is easily adjustable for use by persons of different sizes.

It is still another object of the invention to provide a wearable garment pattern comprised of interchangeable sections that can be easily fit together.

It is still a further object of the invention to provide a wearable garment pattern template that is rapidly adjustable to the shape of the wearer.

It is yet another object of the invention to provide a wearable garment pattern template comprised of strips which are not individually separable from the pattern.

Still yet another object of the invention is to provide a wearable garment pattern template that can be used by the wearer to fit his or herself.

In accord with these objects, which will be discussed in detail below, a wearable garment pattern template configured to be worn by a person, and adapted to permit adjustments to the pattern template during the wearing, is provided. According to one preferred aspect of the invention, the pattern template preferably includes a plurality of detachably coupled sections that are easily snapped or otherwise coupled together. According to another preferred aspect of the invention, each section of the template is a framework comprised of a plurality of flexible segments many of which are coupled at pivot points. The adjustable segments are preferably comprised of at least two strips which are longitudinally slidable relative to each other such that the segments are adjustable in length. Once a segment is adjusted in length, the strips of the segment can be locked relative to each other to fix the length of a segment.

In accord with the invention, the segments of the framework define either triangles with sides of a particular length (as adjusted on the wearer), or quadrilaterals having sides of a set length (as adjusted on the wearer) and at least one fixed angle between two of the sides. In either instance, after adjustment, each triangle or quadrilateral can assume only a single configuration, and is not subject to distortion due to rotation about pivot points as the angles between the sides will not change with the individual segments being locked at their respective lengths.

It is noted that every pivot point on the perimeter of the sections of the garment pattern template (with the exclusion of dart leg points which are already connected to the interior) is connected by a flexible segment to an interior point or another pivot point on the perimeter. As such, the garment pattern template, once removed from the person and laid flat, maintains its shape without distortion. The garment pattern template can then be used as a template to cut fabric for a garment.

Furthermore, indicia are provided on the segments to facilitate fitting the garment pattern template to a wearer, and further permit the garment pattern template to be easily fit to oneself while using a mirror. That is, the indicia preferably permit the wearer (or the tailor) to rapidly determine that the pattern is being symmetrically fit to the body without requiring reference to small, difficult to read numeric measurements.

Additional objects and advantages of the invention will become apparent to those skilled in the art upon reference to the detailed description taken in conjunction with the provided figures.

BRIEF DESCRIPTION OF THE DRAWINGS

Prior art

Prior art

Prior art

DETAILED DESCRIPTION OF THE PREFERRED EMBODIMENTS

Figure 7:
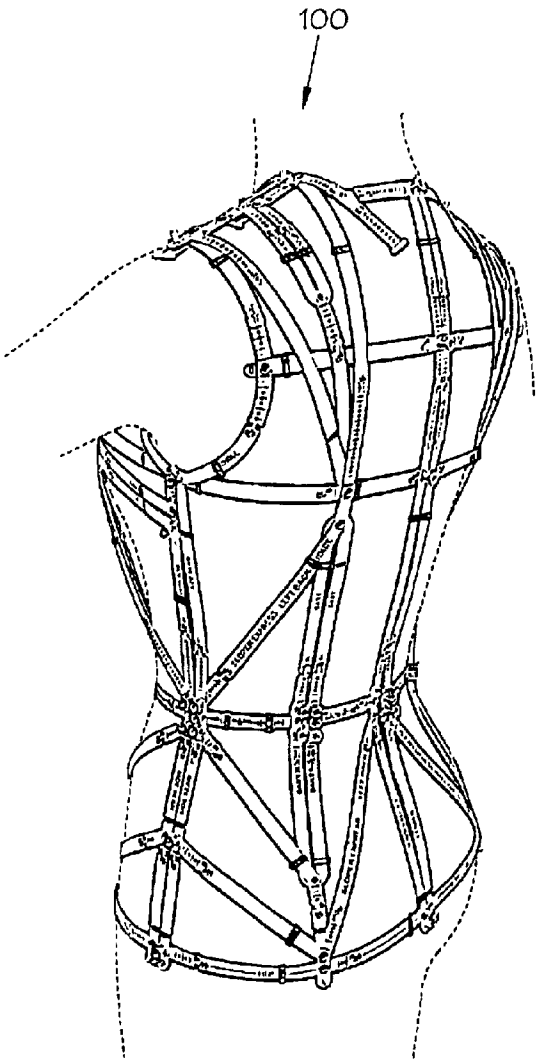
FIG. 7 is a rear perspective view of one embodiment of the wearable pattern template according to the invention shown on the body form.
Figure 6:
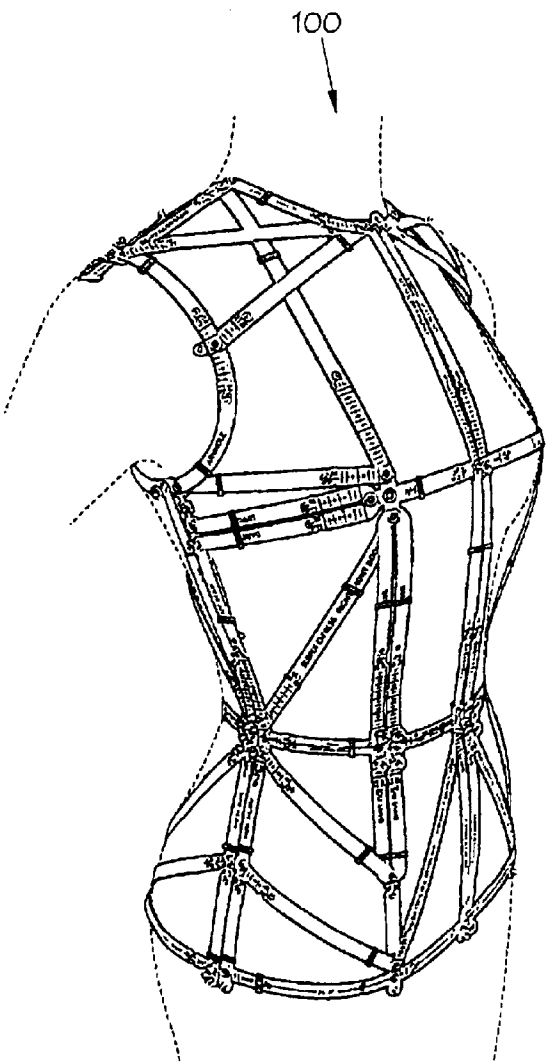
FIG. 6 is a front perspective view of one embodiment of a wearable pattern template according to the invention shown on a body form.

In accord with the invention, a wearable pattern template 100 (FIGS. 6 and 7) comprises a plurality of sections, including right and left front bodice sections 102, 104 (FIG. 8), right and left back bodice sections (right back bodice section 402 shown in FIG. 17), and optionally right and left front hip sections (right front hip section 500 shown in FIG. 18), right and left back hip sections (right back hip section 530 shown in FIG. 19), right and left front skirt sections (right front skirt section 552 shown in FIG. 20), right and left back skirt sections (not shown but substantially similar to the right and left front skirt sections), right and left front pant sections (right front pant section 572 shown in FIG. 21), and right and left back pant sections (right back pant section 600 shown in FIG. 21) that are detachably couplable together about the body of a wearer of the pattern template. When worn by and fit to a wearer, the pattern template 100 should fit loosely over the body of the wearer the way a garment would fit; i.e., it is not intended to conform to every curve of the body.

Figure 8:
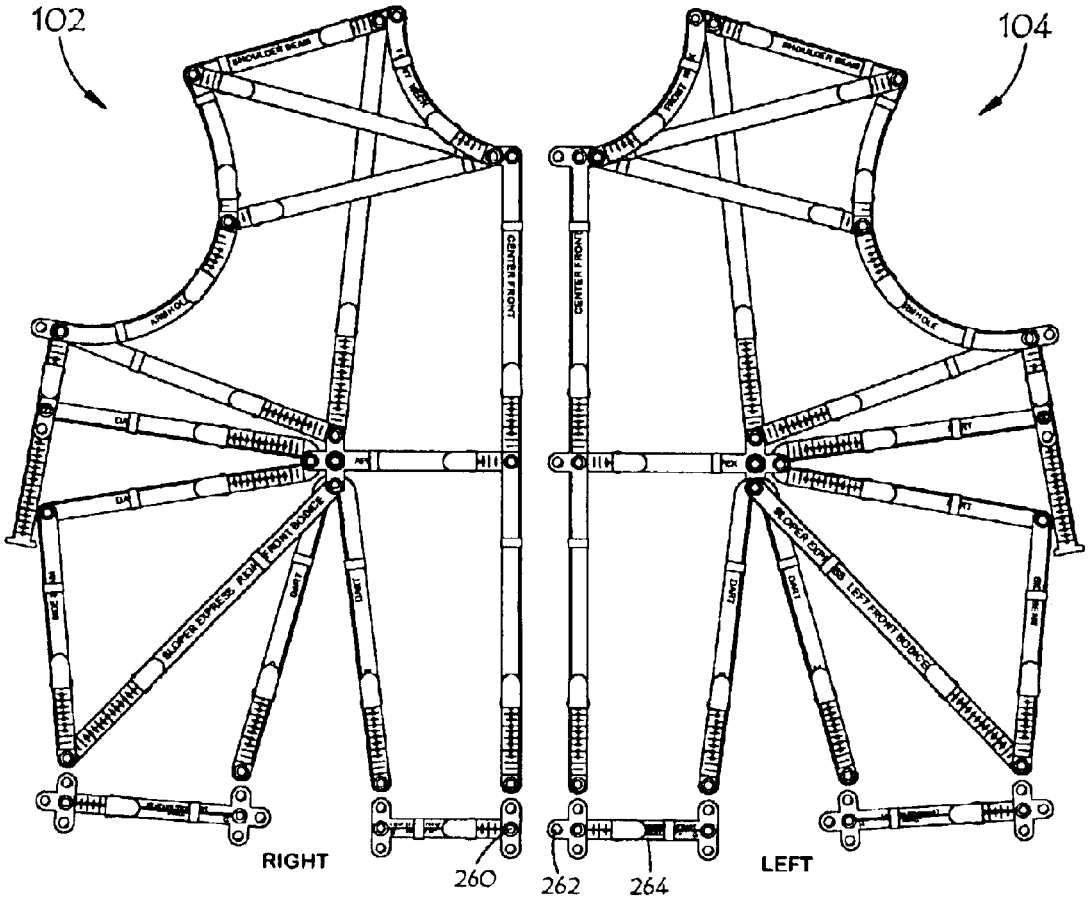
FIG. 8 is a plan view of right and left front bodice sections of a wearable pattern template according to the invention.

Turning now to FIG. 8, right and left front bodice sections 102, 104 of the wearable pattern template 100 are shown. It can be seen that the right and left front bodice sections 102, 104 are substantially mirror images of each other (with the exception of connectors adapted to couple sections together). Likewise, the right and left sections of other portions of the template are also substantially mirror images of each other. Therefore, only the right sections that comprise the template will be described in detail below, with recognition that the respective left sections are substantially the same.

The right front bodice section 102 is a framework of segments, as are all other sections. Before discussing the assemblage of the segments with each other in detail, it is helpful to understand the construction of the individual segments.

Figure 9:
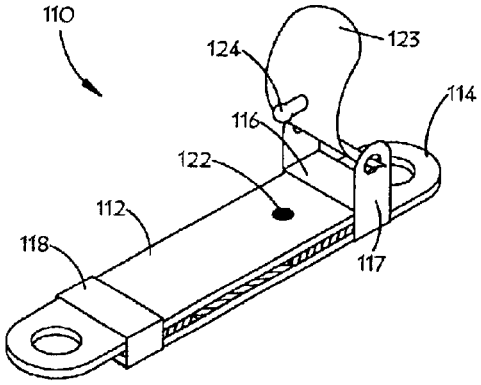
FIG. 9 is a perspective view illustrating the construction of an exemplar segment in a smallest length configuration.

Referring to FIG. 9, each segment, e.g., exemplar segment 110, generally includes two strips 112 (overlying), 114 (underlying) that are preferably longitudinally slidable relative to each other and can be locked relative to each other to fix the length of the segment. The strips are preferably approximately 0.375 inches in width, though other widths can be used. Each of the strips 112, 114 is preferably provided with an end piece 116, 118 longitudinally fixed thereto. The fixed end piece 116 on strip 112 wraps around the strip 114, yet permits longitudinal movement of strip 114 relative thereto. Likewise, the fixed end piece 118 on strip 114 wraps around strip 112, yet permits longitudinal moved of strip 112 relative thereto. When strips 112, 114 are moved relative to each other to the configuration of FIG. 10 such that they provide a segment having a longest length for the respective strips, the end pieces 116, 118 interfere with each other to function as stops to prevent the strips 112, 114 from separating.

Figure 10:
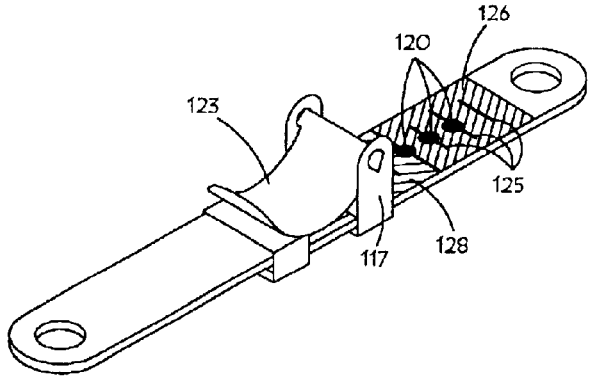
FIG. 10 is a perspective view illustrating the construction of an exemplar segment in a largest length configuration.

Referring to FIGS. 9 and 10, the end piece 116 of the overlying strip 112 is provided with a clevis 117, and a flap 123 is rotatably attached to the clevis 117. A ball head 124 is attached to the flap 123.

In addition, the underlying strip 114 is provided with a plurality of longitudinally displaced holes 120, and the overlying strip 112 is provided with a stop hole 122. Once a segment 110 is adjusted in length, the ball head 124 on the a flap 123 is removably inserted through the stop hole 122 and an aligned hole 120 on the underlying strip 114 to fix the length of the segment. Other means for locking the strips in relative position can also be used. One such means is a spring-like clamp which holds the strips together. Another means is to provide one strip with a longitudinal slot and the other strip with a screwpost that enters the slot. A cap can be screwed over the screwpost to clamp the strips together. The clamp and slot/screwpost assemblies permit infinite adjustment of the strips along their lengths. Whichever method is used to lock the strips together, the locking device is preferably permanently attached to the segments, either to the overlying or to the underlying strip or wraps around both strips to permit rapid adjustment of the length of the segment.

The displaced holes 120 are preferably spaced with respect to non-numerical indicia 125 which provide a quick visual indication to the user of the wearable pattern template as to the symmetry of the fit of the template. In addition, the indicia preferably also corresponds to a numerical measurement (located, e.g., every ⅛ inch or every 1 cm) and preferably with additional indicia 126, 128 being provided at set increments. For example, if linear indicia are provided every one-eighth inch, it is preferable that every one-half inch or full inch the strip surface about the indicia be altered in shade, color, or pattern to provide quick visual cue as to numerical measurement without necessitating resort to reading numbers corresponding to the numerical measurement.

Figure 11:
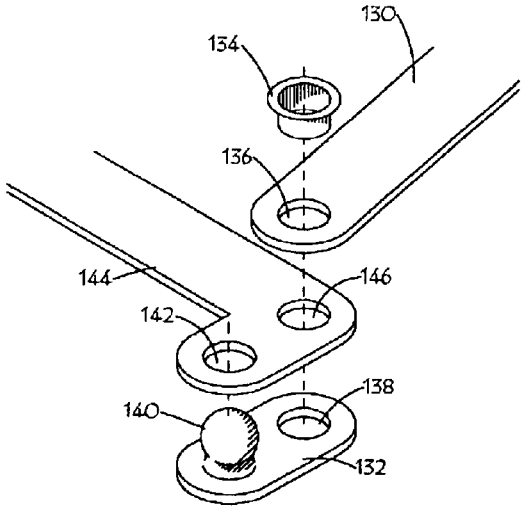
FIG. 11 is a perspective exploded view of the construction of an exemplar assembly of multiple segments.
Figure 12:
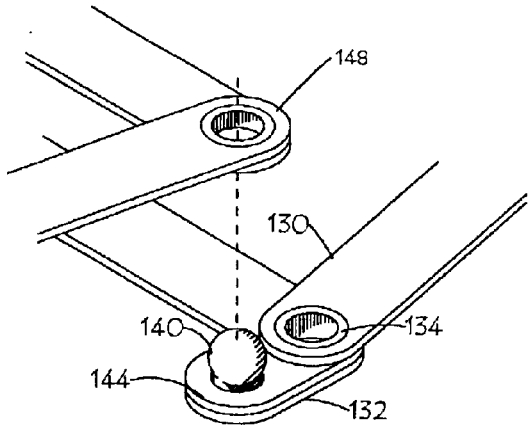
FIG. 12 is a perspective view of the assembly of the multiple segments of FIG. 11.

Referring to FIGS. 11 and 12, the segments are coupled to each other. A segment 130 may be permanently pivotably coupled to another segment 144 with an eyelet 134 (or rivet or other means) positioned within aligned holes 136, 146 in the ends of each of the segments 130, 144. Other segments or sections can be removably coupled together, e.g., by providing an end of coupler segment 132 with a ball head 140 over which a pivot hole 142 of the segment 144 can be inserted, and all segments 130, 144, 132 can then be connected at their respective holes 136, 156, 138 with the eyelet 134. Connecting the coupler segment 132 at two locations (hole 138 and head 140) keeps coupler segment 132 from shifting relative to segments 130 and 144 when coupling to another section 148 (FIG. 12).

Figure 13:
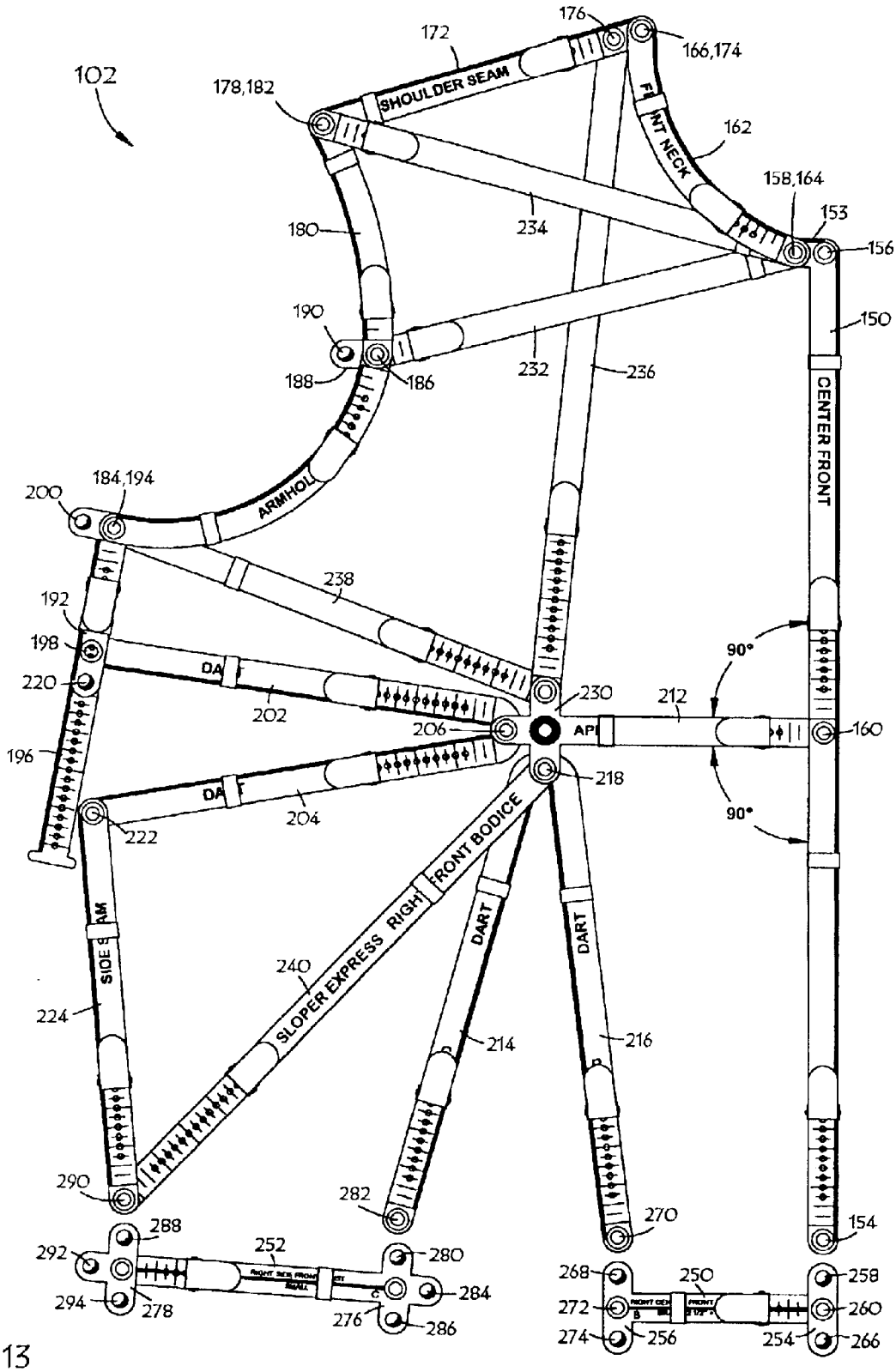
FIG. 13 is a plan view of the right front bodice section of a wearable pattern template according to the invention.
Figure 15:
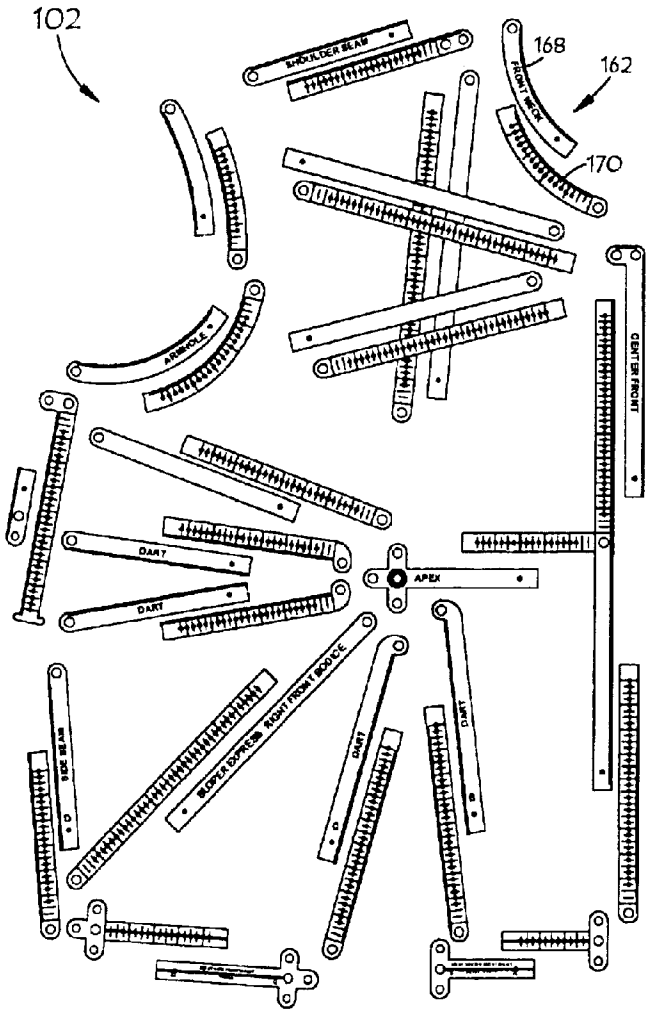
FIG. 15 is a fully exploded view of the right front bodice section of FIG. 13, including explosion of the segment and with segment connectors not shown.
Figure 14:
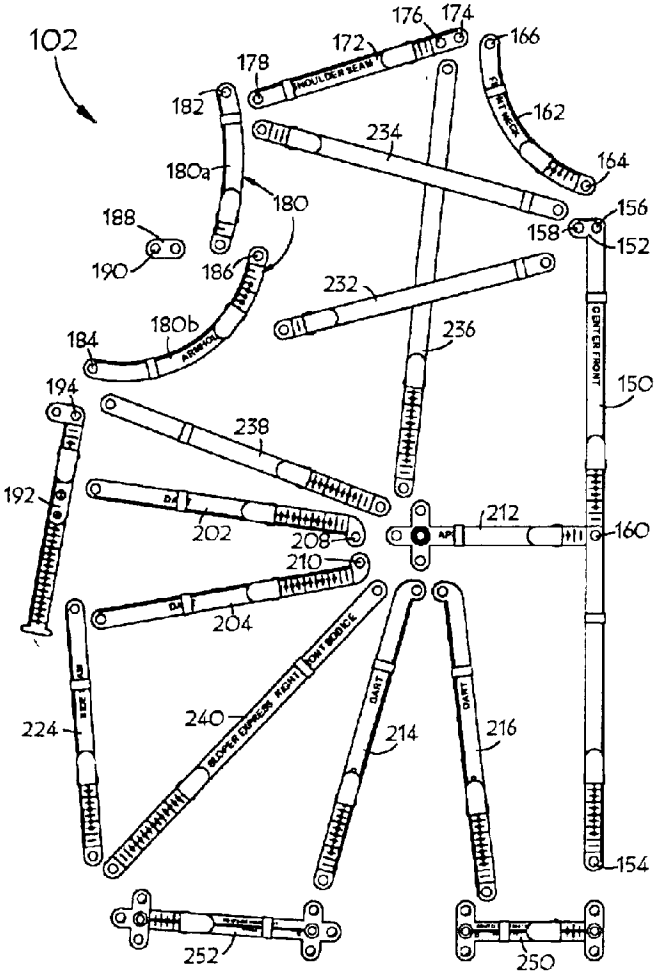
FIG. 14 is a partially exploded view of the right front bodice section of FIG. 13, shown exploded down to the level of the segments and with segment connectors not shown.

With that foundation, referring now to FIGS. 13, 14 and 15, right front bodice section 102 includes a center front segment 150 having an upper preferably 90° angled portion 152 and four holes: holes 154, 156, 160 in a straight portion, and hole 158 in the angled portion 152. An arced front neck segment 162 includes two pivot holes 164, 166. The front neck segment 162 is pivotably coupled to the center front segment 150 at pivot holes 158 and 164. The offset of the angled portion 152 allows the curve of the neck segment to be relatively shallow and sets the beginning of the front neck curve square to the front center segment 150 at 153. Particularly referring to FIG. 15, the front neck segment 162, like preferably most curved segments in the pattern template 100, is comprised of strips 168, 170 having a constant radius of curvature so that the strips can slide easily relative to each other to adjust the segment in length. It is recognized that the curved shape defined by the segments can be modified by the user using a French curve or other means to correspond to another curve, if necessary or desired.

A shoulder seam segment 172 includes a first end with two longitudinally displaced holes 174, 176 and a second end with another hole 178. The shoulder seam segment 172 is pivotably coupled to the front neck portion at holes 174, 166, respectively, and does not pivot about hole 176. In addition, holes 174 and 178, and holes aligned therewith, are also used to couple the right front bodice 102 to the right back bodice 402.

A compound armhole segment 180 is pivotably coupled at one end (at hole 182) to the shoulder seam segment 172 (at hole 178), and includes another hole 184 at its other end. The compound armhole segment 180 is actually comprised of two discrete segments 180*a*, 180*b*, each with a different radius of curvature (e.g., approximately 5.45 inches and approximately 2.58 inches, respectively) which are coupled at pivot 186 to thereby permit greater variation to armhole curve design. A French curve is preferably used to connect the locations 182, 184 and 186 when transferring the shape of the pattern template 100 to fabric. In addition, a connector 188 is coupled to the armhole segment at pivot 186.

Figure 17:
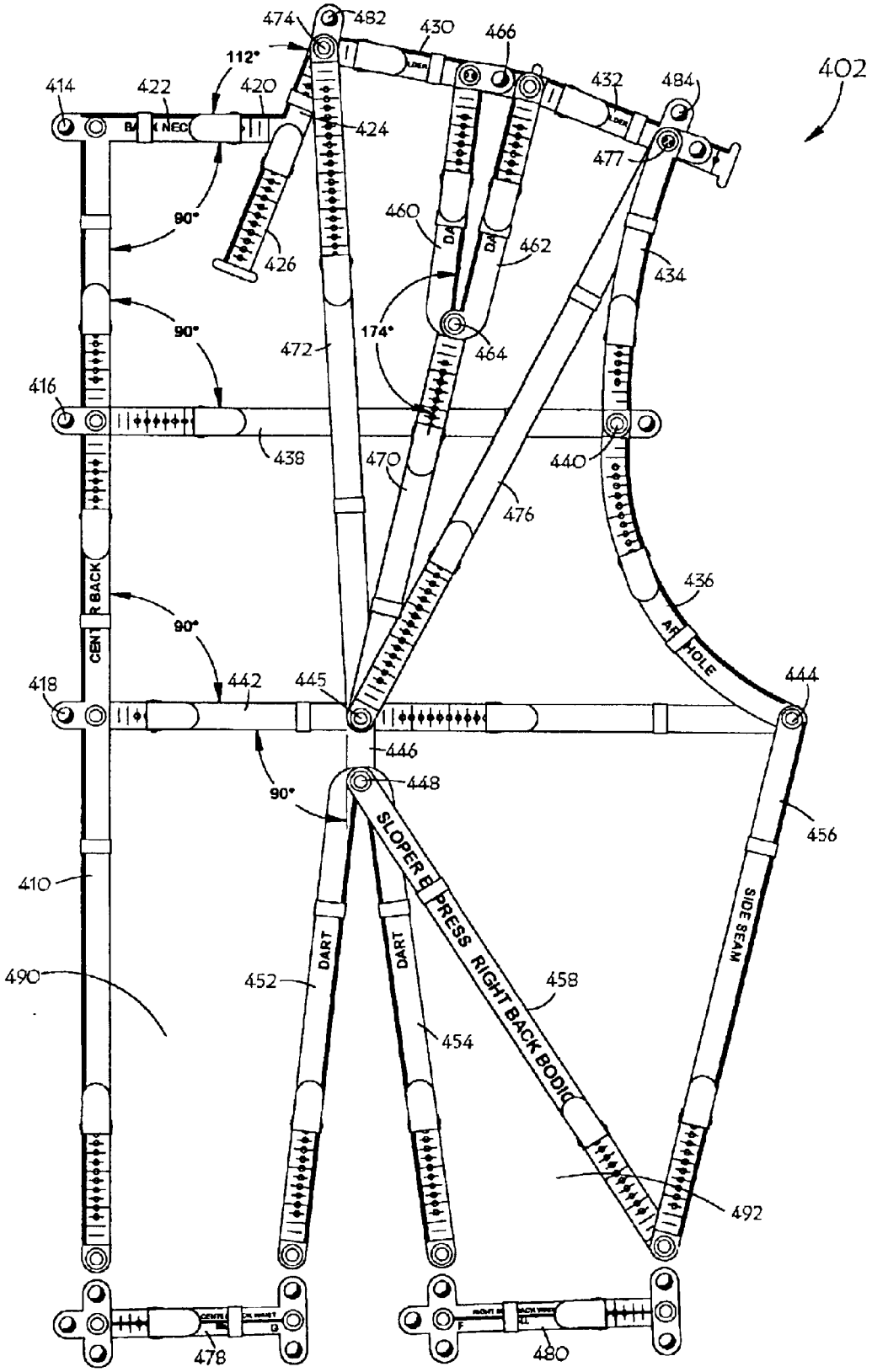
FIG. 17 is a plan view of a right back bodice section of a wearable pattern template according to the invention.

An upper side seam segment 192 is pivotably coupled at a hole 194 at one end to the hole 184 of the armhole segment 180. A lower strip 196 of the segment 192 extends past pivot hole 198 to allow a large variance in length of the segment 192. A snap 200 is provided at a preferably 90° angle relative to the upper side seam segment 192 and permits attachment to hole 444 of the right back bodice 402 (FIG. 17).

An upper side dart segment 202 is pivotably coupled to a lower side dart segment 204 at pivot 206 to define a side dart of the pattern template 100. All dart segments preferably include laterally offset pivot holes, e.g. pivot holes 208, 210; i.e., the segments are angularly rotatable about a point lying off the longitudinal axis of each of the dart segments 202, 204. Thus, the darts defined between any two dart segments are not shortened as the angle between the darts is decreased. Pivot 206 is located on a bust span segment 212 that is held rigidly, preferably at 90° relative thereto, to the center front segment 150.

First and second waist dart segments 214, 216 are also pivotably coupled to the bust span segment 212 at 218, and define a waist dart.

The upper side seam segment 192 is provided with a snap 220 that is adapted to snap into a pivot hole 222 at the coupling of the lower dart segment 204 and a lower side seam segment 224 when the pattern template 100 is on the wearer or when it is desired to have a bodice garment with waist dart only, and no side dart.

The above segments (minus the bust span segment 212) define the outline of the right front bodice section 102. More particularly, each of the outline segments (in all of the sections) includes a preferably heavy weight line indicia which defines a stitching line for the garment for which the pattern template 100 is adapted. When the right front bodice section 102 is removed from the wearer and traced onto paper or fabric, these lines are followed. A seam allowance is then added about the tracing.

The bust span segment 212 together with the same element from the left front bodice section 104 define the bust span, which is preferably held rigidly at a 90° angle to the center front segments. The bust span segment 212 preferably includes a cruciate end 230 to provide non-overlapping and non-interfering pivot locations for the coupling of various segments. Segments 202 and 212 together with the corresponding segments from the left front bodice provide the front bust measurement.

Internal brace segments are also provided to hold the outlining segments in correct position, such that the right front bodice section will not distort once removed from the wearer. Brace segment 232 holds the mid-armhole point 186 in correct position. Brace segment 234 holds the shoulder seam segment 172 at the measured angle. Brace segment 236 holds the intersection of the shoulder seam and the front neck (also called the HPS or high point of shoulder) in proper place. In addition, brace segment 236 together with second waist dart segment 216 holds the right front bodice section 102 to its full length (also called the full front length). Brace segment 238 holds the armhole/side seam intersection pivot point 194 at its measured position. Brace segment 240 operates to hold dart segments 204 and 214 open to the proper angle. Each of the above brace segments may be otherwise oriented relative to the outline segments provided that the functionality of the segments is maintained. However, it is preferable that the brace segments are oblique relative to horizontal and vertical orientations when the wearable pattern template is worn.

Figure 18:
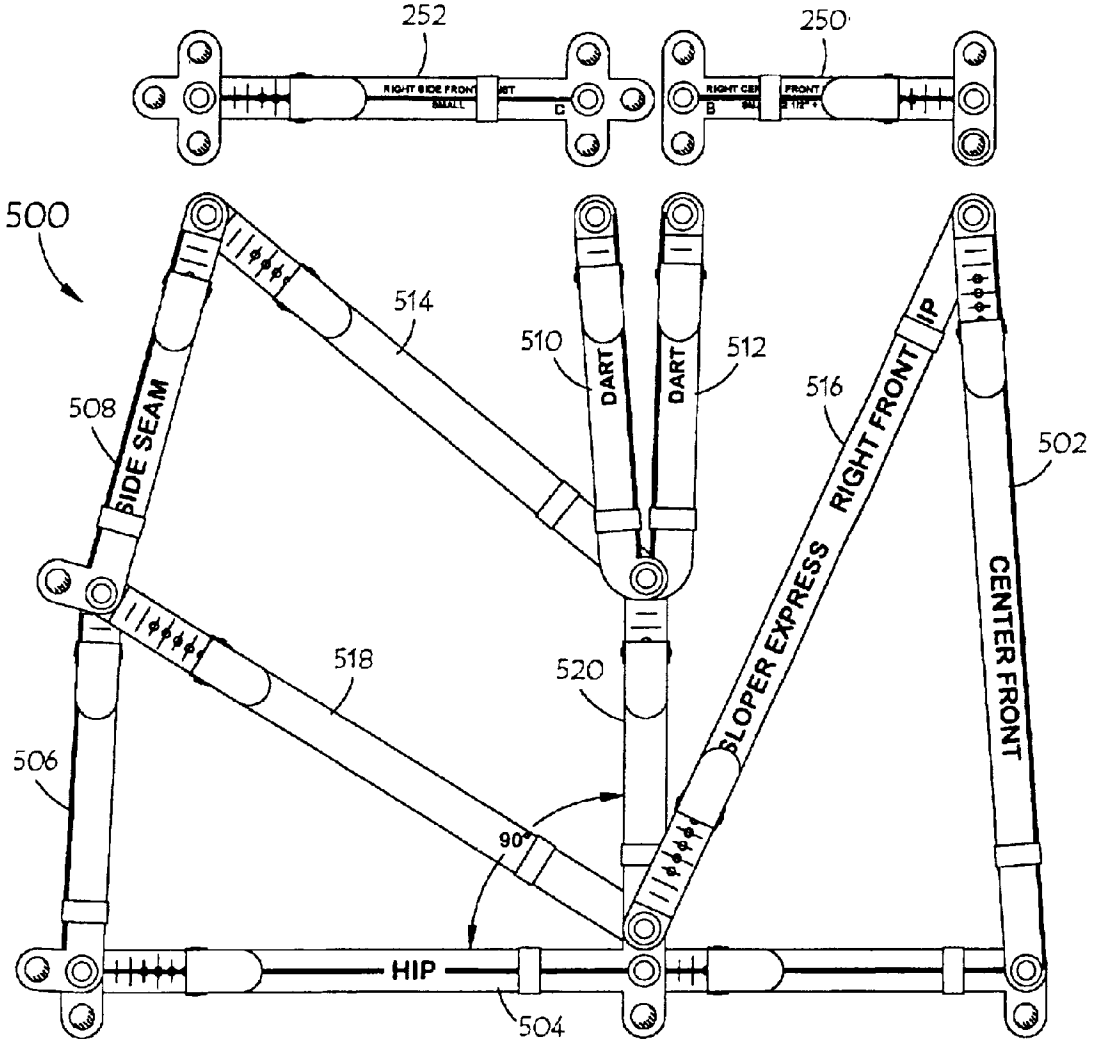
FIG. 18 is a plan view of a right front hip section and waist segments of a wearable pattern template according to the invention.

The right front bodice section is preferably always used in association with two waist segments: a center front waist segment 250 and a side front waist segment 252. Center front waist segment 250 includes two end portions 254, 256 oriented transverse to the length of the segment. End portion 254 includes a snap 258 that attaches to the center front segment 150 at hole 154, and a hole 260 that accepts a snap 262 from the left center front waist segment 264 of the left front bodice section 104 (FIG. 8), and a snap 266 at which the center waist segment can be coupled to a hip section 500 (FIG. 18). End portion 256 includes a snap 268 that attaches dart segment 216 at a hole 270, a hole 272, and a snap 274 at which the center waist segment 250 again can be coupled to a hip section 500. Side front waist segment 252 includes two cruciate end portions 276, 278. End portion 276 includes a snap 280 that attaches to dart segment 214 at hole 282, a snap 284 which can be fit in hole 272 of waist segment 250 on the wearer or if no waist dart measurement is required, and a snap 286 at which the side front waist segment 252 can be coupled to a hip section 500 (FIG. 18). End portion 278 includes a snap 288 that attaches to the side seam segment 224 at hole 290, a snap 292 that is adapted to snap into a hole on a right side back waist segment of the right back bodice section 402 (FIG. 17), and a snap 294 which can be fit in hole on a hip section.

Figure 1:
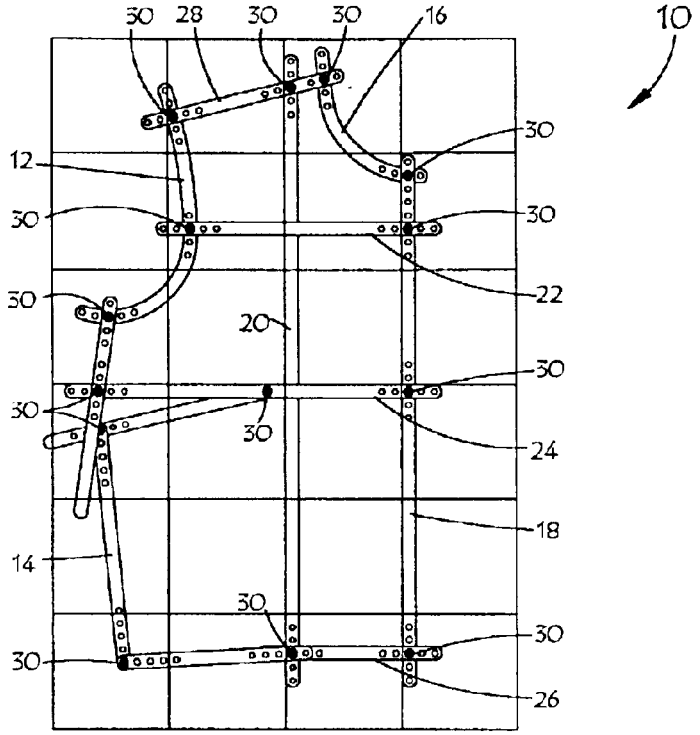
FIG. 1 PRIOR ART
FIG. 1 shows the garment pattern template described in U.S. Pat. No. 2,869,236 to Franklin positioned against a rectangular grid.
Figure 2:
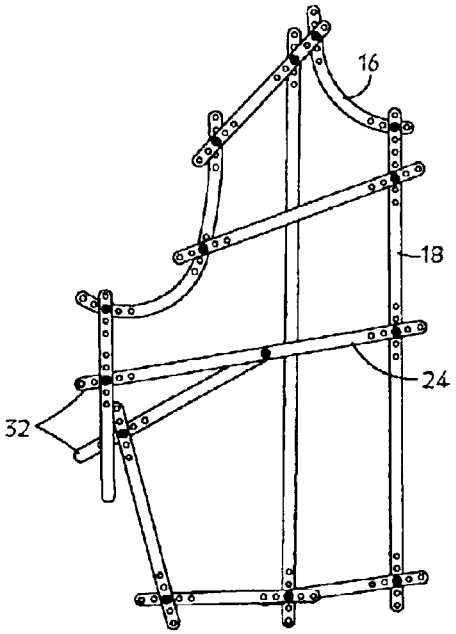
FIG. 2 PRIOR ART
FIGS. 2 and 3 illustrate the range of distortion inherently permitted by the pattern template shown in FIG. 1 when used according to the teaching in the Specification of U.S. Pat. No. 2,869,236.
Figure 3:
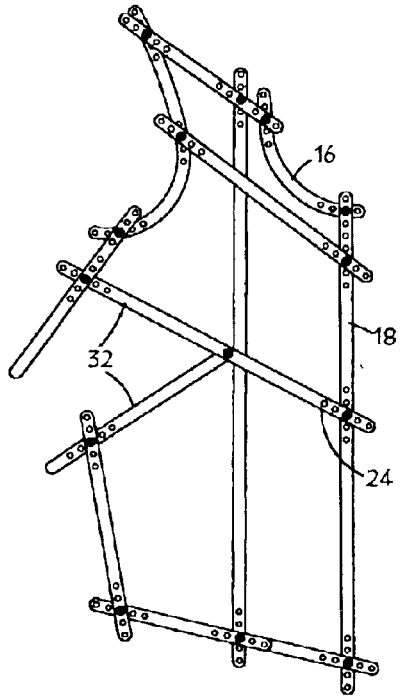
FIG. 3 PRIOR ART
Figure 4:
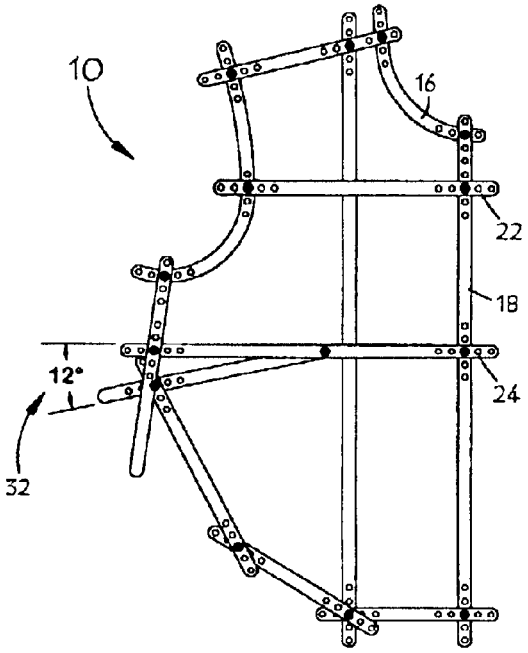
FIG. 4 PRIOR ART
FIGS. 4 and 5 illustrate the range of distortion at the darts inherently permitted by the pattern template shown in FIG. 1 even when steps beyond the teaching in the Specification of U.S. Pat. No. 2,869,236 are used.
Figure 5:
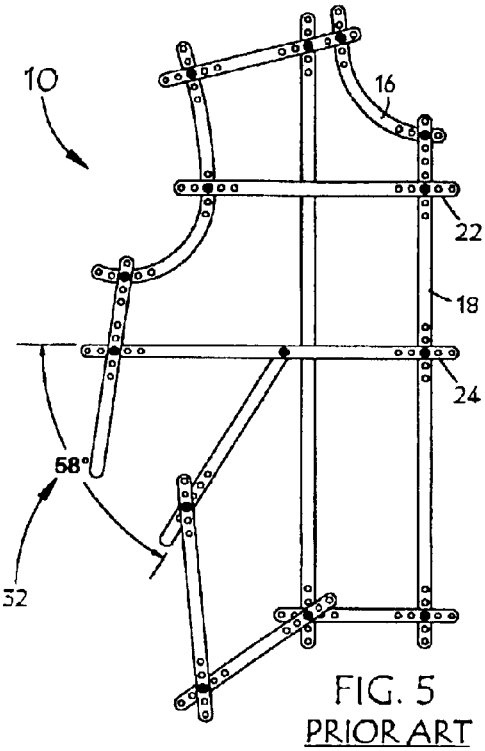
FIG. 5 PRIOR ART
Figure 16:
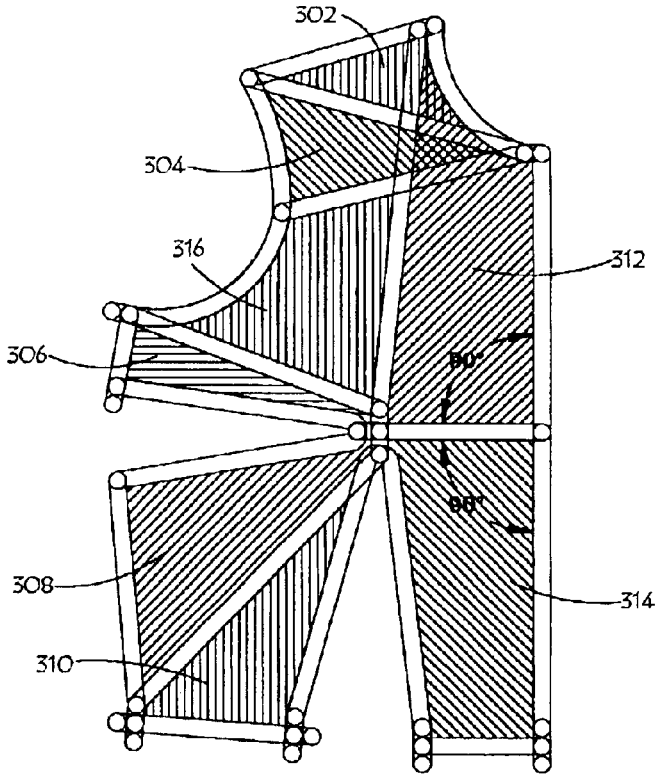
FIG. 16 is a schematic view of the right front bodice section of FIG. 13 illustrating the triangles and fixed angle quadrilaterals formed by the segments of the section.

From the above it is seen that every pivot point along the segments defining the outline of the right front bodice section (excluding where the dart segments attach to the outline) has associated therewith another segment, i.e., a brace segment (discussed above), connecting it to another pivot point. Referring to FIG. 16, the segments of section 102 (outline and brace segments) thereby cooperate to define a plurality of triangles 302, 304, 306, 308, 310, the sides of which can be fixed in length, and a plurality of quadrilaterals 312, 314 the sides of which can be fixed in length and in which two sides of each quadrilateral have a fixed preferably 90° angle therebetween. Quadrilateral 316 is also formed, but does not include a fixed angle. Rather, its shape is held because its sides belong to triangles or fixed angle quadrilaterals. For purposes of this specification and the claims, triangles and quadrilaterals refer to three- and four-sides shapes, respectively, wherein such shapes may include both straight and curved sides. Every segment comprising the outline portion is fixed in relative position by the triangles and fixed-angle quadrilaterals. Therefore, when section 102 is removed from the wearer, its shape (all segment lengths and angles therebetween) is maintained, and no distortion can be introduced. As such, the measurements and shape of the wearer can be quickly and accurately transferred to fabric or paper.

With the above detailed description of the right front bodice section 102, a more general description will now be provided with respect to the other sections that comprise the pattern template 100.

Turning now to FIG. 17, the right back bodice section 402 is shown. The section 402 includes a center back segment 410 which include snaps 414, 416, 418 that couple into holes on a left back bodice section (not shown). A back neck segment 420 includes a first portion 422 aligned at a 90° angle with the center back segment 410, and a second portion 424 angled from 90° to 135°, and most preferably 112°, relative to the first portion. It is noted that an underlying strip 426 of the second portion 424 has a relatively long extension for more variance in length. The user of the pattern template 100 can draw a curve along the first and second portions 422, 424 with a French curve. Alternatively, a curved neck segment could be used.

Center and side shoulder segments 430, 432 are coupled between the second portion 424 of the back neck segment 420 and a compound armhole segment comprised of curved segments 434, 436. Shoulder dart segments 460, 462 are rotatably coupled between the inner ends of the shoulder segments 430, 432, and dart apex pivot 464. An across-the-back segment 438 extends from the center back segment 410, at a preferably fixed angle of 90° relative thereto, to the pivot 440 of the curved segments 434, 436. The across-the-back segment 438 defines the horizontal balance line (HBL) and should remain parallel to the floor so that a garment hangs correctly. A full-width-of-back segment 442 also extends from the center back segment 410 at a preferably fixed 90° angle and is pivotably coupled to the lower end 444 of armhole segment 436. The full-width-of-back segment 442 includes a pivot 445, and a fixed strip 446 that extends downward from the location of pivot 445 at a fixed preferably 90° angle from the horizontal of the segment 442 to define a pivot hole 448 coincident with a back waist dart apex. The dart apex (pivot 448) is preferably located one inch below the top edge 450 of the full-width-of-back segment 442. Dart segments 452, 454 are pivotably coupled at pivot 448 and define the waist dart. A side seam segment 456 is pivotably coupled at one end to the lower end 444 of the armhole, and at its other end to a first brace segment 458.

The first brace segment 458 extends between the side seam segment 456 and pivot 448, and is responsible for opening the waist dart segment 454 to the proper angle. A second brace segment 470 extends between the pivot 445 and shoulder dart apex pivot 464. Shoulder dart segment 460 is preferably fixed relative to the axis of the second brace segment 470, preferably at an angle of approximately 174°, to act as a brace to prevent the dart apex 464 from shifting laterally when shoulder dart segment 462 is rotated relative to shoulder dart segment 460. Snap 466 attached to dart 460 permits closing of the shoulder dart. A third brace segment 472 extends between pivot 445 and a pivot 474 at the intersection of the back neck segment 420 and center shoulder segment 430. A fourth brace segment 476 extends between pivot 445 and a pivot 477 at the intersection of the side shoulder segment 432 and first armhole segment 434, and is responsible for opening the shoulder dart segment 462 to the proper angle.

Center and side back waist segments 478, 480 provide similar functionality to center and side front waist segments 250, 252 (FIG. 13). That is, segment 478 provides a fourth side to quadrilateral 490, and segment 480 provides a third side to triangle 492. In addition, the waist segments permit closing of the waist dart (segments 452 and 454), and also allow the right back bodice section 400 to be coupled to a lower section, such as a hip section.

Snaps 482, 484 attach into holes 166, 178, respectively, on the right front bodice section 102.

The right and left front bodice sections 102, 104 coupled to the right back bodice section 402 and left back bodice section together define a wearable pattern template in the form of a bodice. Numerous other sections can be provided which can be coupled to the bodice template or used separately therefrom.

Referring to FIG. 18, a right front hip section 500 is shown comprising segments 502, 504, 506, 508, 510, 512, 514, 516, 518 and 520.

Figure 19:
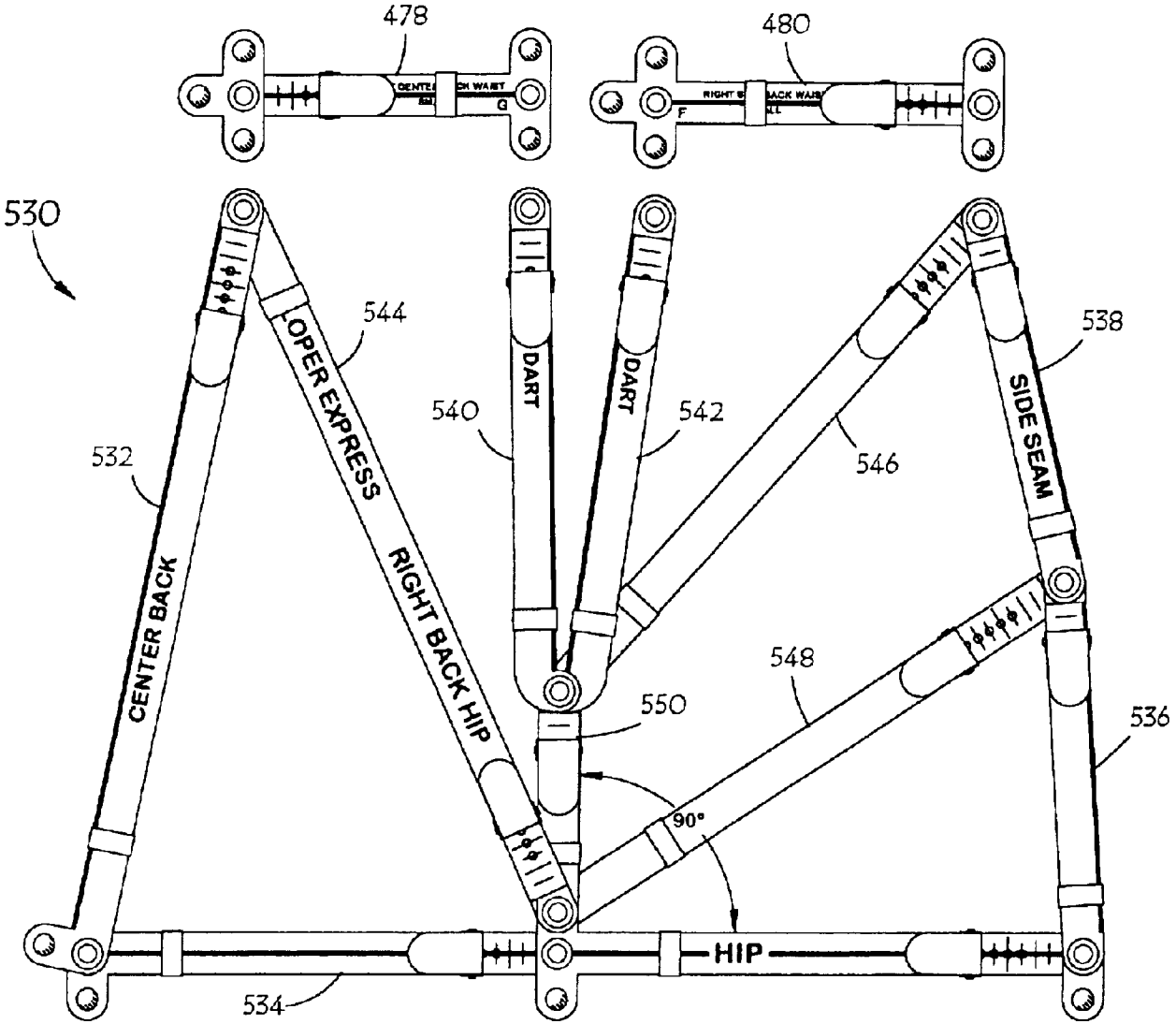
FIG. 19 is a plan view of a right back hip section and waist segments of a wearable pattern template according to the invention.

Referring to FIG. 19, a right back hip section 530 is shown comprising segments 532, 534, 536, 538, 540, 542, 544, 546, 548 and 550.

Figure 20:
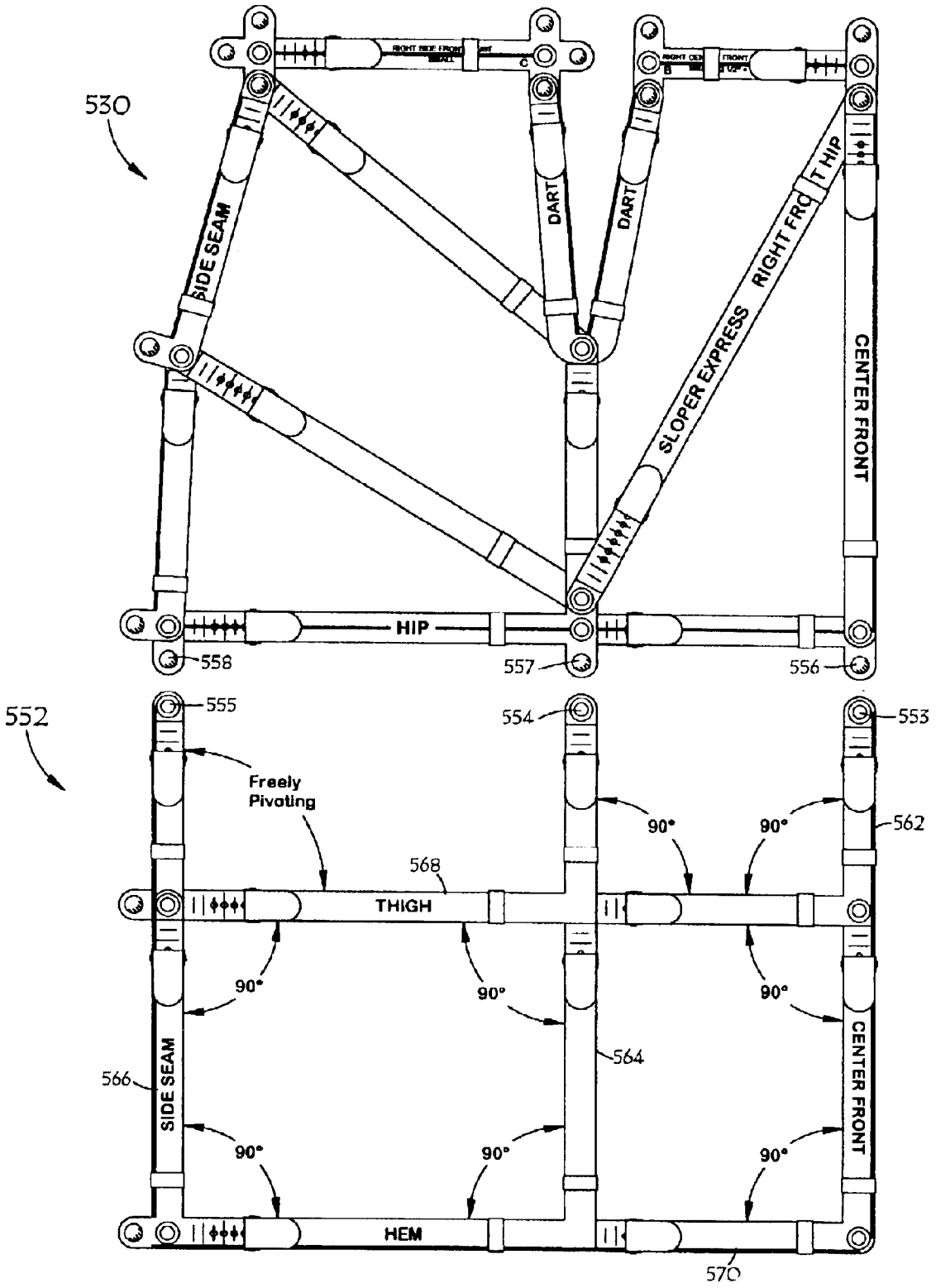
FIG. 20 is a plan view of the right front hip section and right front skirt sections of a wearable pattern template according to the invention.

Referring to FIG. 20, a right front skirt section 552 includes segments 562, 564, 566, 568 and 570. Right front skirt section 552 is shown aligned relative to the right front hip section 530 to which it may be coupled via holes 553, 554, 555 and snaps 556, 557, 558. The right back skirt section is not shown, but is substantially the same as the right front skirt section 552.

Figure 21:
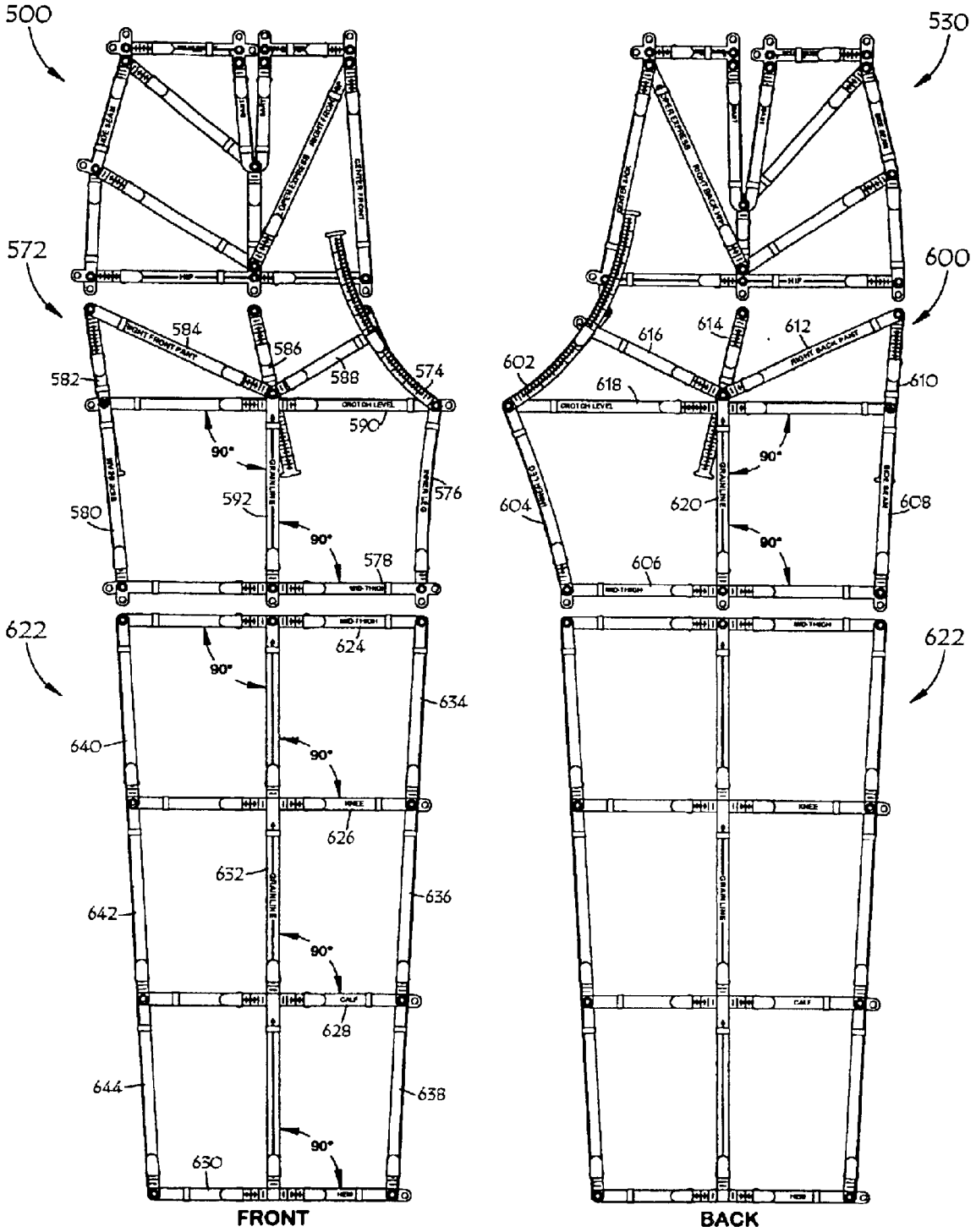
FIG. 21 is a plan view of the right front and back hip sections and right front and back pant sections of a wearable pattern template according to the invention.

Referring to FIG. 21, a right front pant section 572 includes segments 574, 576, 578, 580, 582, 584, 586, 588, 590 and 592. The right front pant section 572 is shown aligned relative to the right front hip section 500 to which it may be coupled. A right back pant section 600 includes segments 602, 604, 606, 608, 610, 612, 614, 616, 618 and 620. The right back pant section 600 is shown aligned relative to the right back hip section 530 to which it may be coupled. A right front and right back pant leg section 622 includes segments 624, 626, 628, 630, 632, 634, 636, 638, 640, 642 and 644. The pant leg section 622 is shown aligned with the right front pant section 572 and right back pant section 600 to which it may be coupled.

Each of sections 500, 530, 552, 572, 600 and 622 is constructed in accord with the principals described in detail with respect to the bodice sections 102 and 402.

There have been described and illustrated herein several embodiments of a wearable pattern template. While particular embodiments of the invention have been shown and described, it is not intended that the invention be limited thereto, as it is intended that the invention be as broad in scope as the art will allow and that the specification be read likewise. Thus, while particular template sections have been disclosed, it will be appreciated that other template sections can be assembled in accord with the inventive concepts disclosed herein. In addition, while particular sizes of strips, strips couplings, rotatable couplings of segments, particular brace segment locations, etc., have been disclosed, it will be understood that numerous variations can be implemented, provided that essential concepts of the invention remain. In addition, while preferred angles have been described, it is appreciated that other angles between segments may be used. By way of example, and not by limitation, where a 90° angle is preferred (as such provides segments oriented vertically and horizontally to aid in measurements for appropriate garment fit), it is appreciated that angles of 90°±10 percent can (less desirably) be used as an approximation, and that various other angles can also be used. It will therefore be appreciated by those skilled in the art that yet other modifications could be made to the provided invention without deviating from its spirit and scope as claimed.

What is claimed is:

1. A garment pattern template, comprising:

a plurality of flexible segments coupled to form a framework conformably fittable about a portion of a human body, at least a plurality of said segments being adjustable in length and individually lockable in an adjusted length, a plurality of said segments together defining at least one of (i) a plurality of triangles wherein said segments have pivotable couplings at corners of said triangles and (ii) at least one quadrilateral wherein said segments have a pivotable coupling at at least one corner thereof and a fixed angle defined between two adjacent sides thereof, wherein when said segments are locked in said adjusted length said segments cannot rotate relative to each other about said pivotable couplings such that said at least one of said plurality of triangles and at least one quadrilateral are fixed in shape.

2. A garment pattern template according to claim 1, wherein:

said plurality of segments include at least one set of two dart segments which together define a garment dart angle therebetween and which are pivotably coupled substantially at an apex of said dart angle, wherein one of said dart segments of said set defines a side of one of said triangular and quadrilateral shapes, and the other of said dart segments of said set defines a side of another of said triangular and quadrilateral shapes.

3. A garment pattern template according to claim 1, wherein:

said segments are arranged into sections, and said sections are couplable together such that said garment pattern template is wearable by a person.

4. A garment pattern template according to claim 3, wherein:

said sections are removably couplable together.

5. A garment pattern template according to claim 3, wherein:

said wearable garment pattern template is in the form of a bodice.

6. A garment pattern template according to claim 3, wherein:

said wearable garment pattern template is in the form, of a skirt.

7. A garment pattern template according to claim 3, wherein:

said wearable garment pattern template is in the form of pants.

8. A garment pattern template according to claim 1, wherein:

each of said segments comprises at least two strips that are longitudinally slidable relative to each other and lockable relative to each other in a relative longitudinal position.

9. A garment pattern template according to claim 1, wherein:

at least two of said segments are angularly rotatable relative to each other about a point lying off an axis from each of said at least two segments to define a dart measurement.

10. A garment pattern template according to claim 1, wherein:

each said segment includes a first end having a first coupling point at which said segment is coupled to another segment and a second end having a second coupling point at which said segment is coupled to yet another segment, and regardless of a respective adjusted length of each said segment, said first and second coupling points remain the same.

11. A garment pattern template according to claim 1, wherein:

at least one of said segments is curved.

12. A garment pattern template according to claim 11, wherein:

said at least one segment is curved about a constant radius of curvature.

13. A garment pattern template according to claim 1, wherein:

each of said segments includes non-numerical indicia indicating a length of said segment.

14. A garment pattern template according to claim 1, wherein:

said fixed angle is approximately 90°.

15. A garment pattern template, comprising:

a plurality of flexible segments coupled to form a framework adapted to fit about a portion of a human body, at least a plurality of said segments having ends and being adjustable in length and individually lockable in an adjusted length, said segments defining (i) outline segments pivotably coupled together at their respective ends at pivots located on a periphery of said framework and (ii) brace segments extending between either two pivots or one of said pivots and a location within said periphery, wherein when said segments are locked in said adjusted length said segments cannot rotate relative to each other about said pivots and a shape of said framework is fixed.

16. A garment pattern template according to claim 15, wherein:

said plurality of segments define a plurality of removably couplable frameworks, and said plurality of frameworks when coupled together define a garment pattern template that is wearable by a person.

17. A garment pattern template according to claim 15, wherein:

when said wearable garment pattern template is fit about the person, said brace segments are oblique relative to horizontal and vertical orientations.

18. A garment pattern template according to claim 15, wherein:

said plurality of outline segments include at least one set of two dart segments which together define a garment dart angle therebetween and which are pivotably coupled substantially at an apex of said dart angle, wherein said garment dart angle is fixed when said outline segments and said brace segments are locked in their respective adjusted lengths.

19. A garment pattern template, comprising:

a plurality of flexible segments coupled to form a framework conformably fittable about a portion of a human body, at least a plurality of said segments being adjustable in length and individually lockable in an adjusted length, wherein at least two of said segments are angularly rotatable relative to each other about a point lying off longitudinal axes of each of said at least two segments to define a dart measurement.

* * * * *